United States Patent [19]

Kuge et al.

[11] Patent Number: 4,523,927

[45] Date of Patent: Jun. 18, 1985

[54] METHOD OF COAL UPGRADING

[75] Inventors: Toshio Kuge; Hiroshi Yokoyama; Shunsuke Nogita, all of Hitachi; Yoichi Nakamura; Katsumi Muroi, both of Kudamatsu, all of Japan

[73] Assignee: Hitachi, Ltd., Tokyo, Japan

[21] Appl. No.: 514,272

[22] Filed: Jul. 15, 1983

[30] Foreign Application Priority Data

Jul. 21, 1982 [JP] Japan ..... 57-125810

[51] Int. Cl.[3] ..... C10L 9/08; C10L 5/32

[52] U.S. Cl. ..... 44/1 B; 44/1 G; 44/6

[58] Field of Search ..... 44/1 B, 1 G, 6

[56] References Cited

U.S. PATENT DOCUMENTS 1,912,697 6/1933 Fife ..... 44/6
3,980,447 9/1976 Franke et al. ..... 44/10 D
4,249,909 2/1981 Comolli ..... 44/1 G

FOREIGN PATENT DOCUMENTS 13067 of 1928 Australia ..... 44/1 B
21490 2/1982 Japan ..... 44/1 B
320918 10/1929 United Kingdom ..... 44/1 B

*Primary Examiner*—Carl F. Dees
*Attorney, Agent, or Firm*—Antonelli, Terry & Wands

[57] ABSTRACT

This invention relates to a method of converting a low-rank coal to produce a high-rank coal which has reduced hygroscopicity as well as increased heating value and lowered moisture content during and after transport or storage. The invention comprises the steps of heat-treating coal for dehydrating the coal and distilling off tar therefrom, vaporizing the tar, and coating the heat-treated coal surface with the tar vapor, whereby the coal surface is coated uniformly.

10 Claims, 4 Drawing Figures

METHOD OF COAL UPGRADING

This invention relates to a method of coal treating for enhancing the quality of a low-grade coal. More particularly, it relates to a method of upgrading a low-rank coal by coating it with tar vapor to produce a high-rank coal which has reduced hygroscopicity as well as increased heating value and lowered moisture content during and after transport or storage.

Coal is generally used as fuel and for other diversified purposes in many fields of chemical industries, but most of coals (which are) actually used for such purposes are high-rank coals generally referred to as bituminous coals. On the other hand, low-rank coals such as subbituminous coals and lignites account for more than half of the whole types of coal occurring on the earth. Such low-rank coals, because of a high moisture content ranging from 20 to 70%, cause reduction in the thermal efficiency of a burner or in transport efficiency. Also, if stored after being dried, they tend to reabsorb moisture or to ignite spontaneously. For these reasons, they have not been widely utilized to date. In order to allow wider utilization of such low-rank coals for fuel and chemical purposes, it is necessary to convert them into coals which absorb little moisture during or after transport or storage by subjecting them to suitable treatments for dehydration and prevention of moisture reabsorption.

Arts relating to coal upgrading have been proposed. One of them is disclosed in Japanese Laid-open Patent Publication No. 56-155295 (1981). In the publication, tar in gas produced by heating coal is recovered in water as liquid tar, thereby forming an emulsion of tar and water, the heated coal is cooled by the emulsion, and the surface of the heat-treated coal is coated with tar deposited thereon, whereby the coal has reduced moisture content. In this method, however, since tar of about room temperature is directly scattered on the heat-treated coal, it seems uneasy to deposit the tar uniformly on the coal surface, whereby moisture content is not reduced well enough.

The present invention has been worked out to eliminate these problems and its object is to coat uniformly a coal to be reformed with tar after heat treatment.

As a result of extensive studies conducted for attaining this object, the present inventors have confirmed the fact that both prevention of moisture reabsorption and dehydration of coal can be accomplished by heating pulverized coal to distill off tar i.e., by subjecting the coal to a destructive distallation and coating the coal with vapor of the distillate tar, and thus achieved the present invention.

The other objects and advantages will be understood by the following explanations referring to the accompanying drawings;
wherein.

As fundamental experiments for confirming the above fact, the present inventors have made multilateral investigations on the relation of a tar coating amount and coating temperature to moisture absorption.

The results of the investigations are shown below by way of an experimental example.

Experimental Example

Type of coal used: A coal from the U.S.A. classified a lignite (the properties being shown in Table 1).

TABLE 1

| | | |
|---|---|---|
| Moisture content (wt %) | 30.8 | |
| Ash (wt %) | 4.4 | (dry weight basis) |
| Heating value (kcal/kg) | 6,180 | (dry weight basis) |
| C (wt %) | 66.2 | |
| H (wt %) | 4.5 | |
| N (wt %) | 1.2 | |

Figure 1:
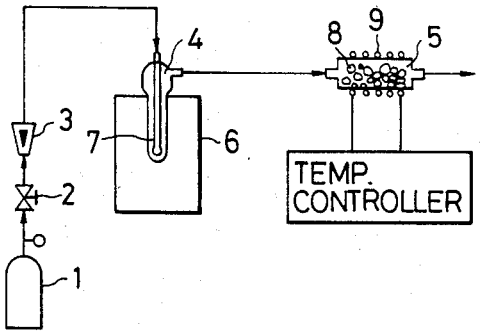
FIG. 1 is, a schematic illustration of the apparatus used in the examples of this invention.

A schematic illustration of an apparatus used for the experiment is shown in FIG. 1. The apparatus consists essentially of a nitrogen gas container 1, a flow control valve 2, a flowmeter 3, a tar containing bottle 4, a coating tube 5 and a heating oven 6.

Coating was performed by filling the coating tube 5, 15 mm in inner diameter, with approximately 7 g of coal 8 which had been heated and dehydrated at a predetermined tar distilling temperature for 4 hours and contacting the coal with vaporized tar. Tar 7 was placed in the bottle 4 having an inner diameter of 20 mm, heated to a predetermined temperature for vaporizing it in the heating oven 6 and contacted with the coal 8 by using an inert gas such as nitrogen (gas) as carrier. The coal temperature was maintained at a predetermined level by controlling turn-on and turn-off of the power for a band heater 9 wound around the coating tube. In order to ensure uniform contact of the vapor with the coal, coarse coal grains with sizes of 2 to 4 mm were used for providing a large void volume to allow easy passage of the gas. Coating was suspended when the tar in the bottle ran out.

Experimental conditions: nitrogen gas was supplied at a flow rate of 0.1 l/min (constant).

Analytical method: equilibrium moisture after the heat-treated coal had been left in a saturated brine desicator (75% R.H.) for 240 hours was determined from the following formula (1). It took approximately 140 hours to attain equilibrium moisture.

$$\frac{\text{(weight of coal after 240-hour standing)} - \text{(weight of coal before putting into the desicator)}}{\text{weight of coal after 240-hour standing}} \times 100$$

Figure 2:
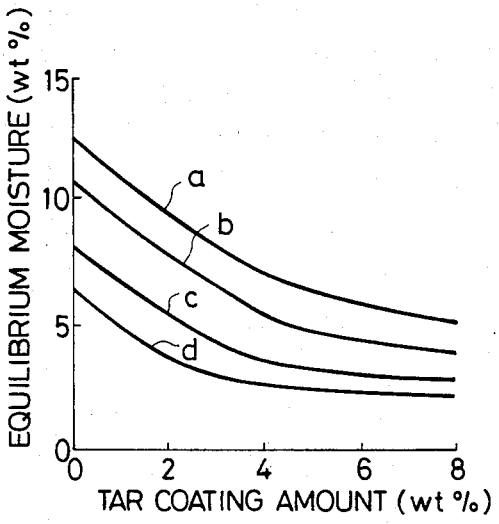
FIG. 2 is a graph showing the relation between tar coating amount and moisture absorption.
Figure 3:
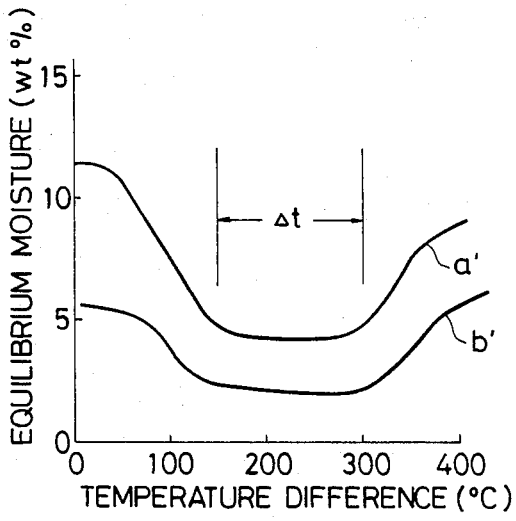
FIG. 3 is a graph showing the relation between equilibrium moisture absorption and temperature difference between tar vapor and coal.

The results obtained from this experiment are shown in FIGS. 2 and 3.

FIG. 2 is a graph showing the relation between tar coating amount and equilibrium moisture. In the graph, a, b, c and d refer to operations conducted at tar distilling temperatures of 200°, 300°, 350° and 400° C., respectively. It will be seen from the graph that the equilibrium moisture is inclined to decrease until the tar coating amount reaches about 5% but it scarcely decreases when this amount exceeds 5%. The amount of tar distilled off from coal was 4 to 12% on the dry weight basis.

It will be also noted that the equilibrium moisture decreases as the tar distilling temperature rises. This is due to the fact that hydrophilic oxygen-containing groups are pyrolyzed and discharged in the forms of $H_2O$, $CO_2$ and CO, thus enhancing the hydrophobic nature of the coal. The oxygen-containing groups are pyrolyzed when heated to above 200° C. A decrease in oxygen causes a corresponding increase in carbon and hydrogen in coal, resulting in an increased heating value of the coal. The coal after distillation of tar at 400° C. according to this invention showed a heating value of 6,800 kcal/kg, which is well comparable to those of bituminous coals.

Tar begins to form at a temperature around 200° C. and the amount of tar formation is at maximum at around 400° C. Above 600° C., the tar yield is nearly zero since its gasification by pyrolysis is promoted at such high temperatures. Therefore, the heat treatment for distilling tar is preferably conducted at a temperature between 200° and 600° C.; especially a temperature of from 350° to 450° C. can effectuate the distillation of tar at the highest efficiency.

FIG. 3 is a graph showing the relation between equilibrium moisture absorption and temperature difference between tar vapor and coal. In the graph, a' and b' refer to operations conducted at a tar distilling temperatures of 300° and 400° C., respectively. As seen from this graph, the equilibrium moisture is low when the temperature difference between the tar vapor and the coal is within the range of from around 150° to 300° C. An increase in the equilibrium moisture when the temperature difference is below 150° C. is attributable to the fact that the tar vapor is difficult to be adsorbed on the coal surface. The equilibrium moisture increases also when the temperature difference exceeds 300° C. This is due to condensation of the tar, which obstructs uniform coating of the coal with the tar vapor. Therefore, it is necessary to keep the temperature difference within the range of from 150° to 300° C. for effecting the uniform coating.

Figure 4:
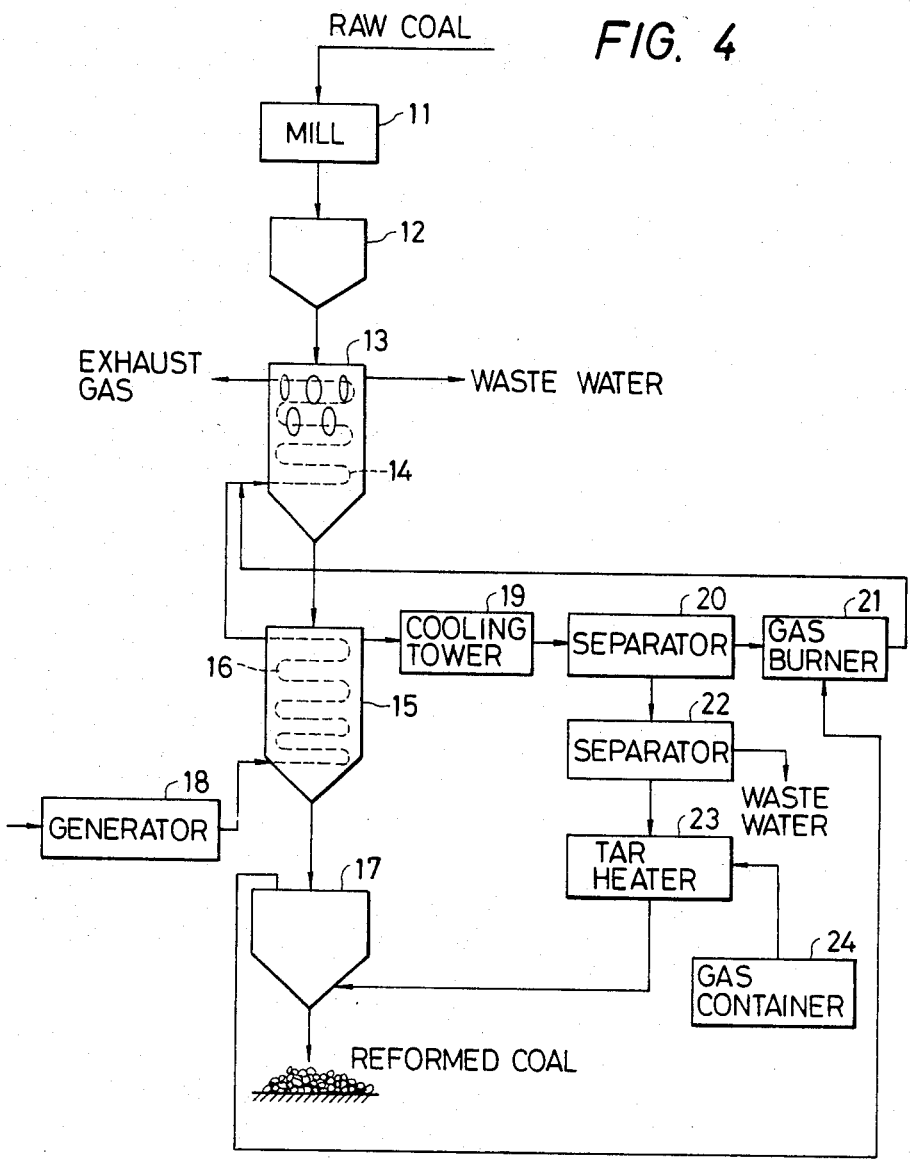
FIG. 4 is a schematic diagram of a system for performing an embodiment of a method of coal upgrading according to the present invention.

Referring to FIG. 4, an example of a system for performing an embodiment of a method of coal upgrading according to the present invention will be described hereinafter.

In FIG. 4, a raw coal is fed to a mill 11 to be pulverized. The pulverized coal is transferred into a drying tower 13 through a hopper 12. The drying tower 13 has therein a heating pipe 14, wherein the coal is heated to a temperature of about 150° C. and dried so that the moisture content is reduced to 1 to 5%. The drying tower 13, further, has a water discharge pipe at an upper portion through which steam and various gaseous material are discharged. The dry coal from the drying tower 13 is fed to a heating tower 15 with a heating tube 16 and heated to about 400° C. thereby. By the heating, tar vapor, water vapor and other gases are produced there at the same time, the humidity content of the dry coal is reduced further, for example to 0.1%. Various gaseous materials are transferred from the heating tower 15 to a cooling tower 19 to cool them to about 60° C. The cooled materials including liquid tar, water and gases are subjected to separation by a separator 20, wherein the gases are separated from liquid tar and water to be transferred to a gas burner 21, wherein the gases are burned. The liquid tar is separated from water by another separator 22 and fed to a heater 23. In the heater 23, the tar is heated to about 400° C. to be vaporized, and controlled so that temperature difference between the tar vapor and the dry coal from the heating tower 15 is kept to 150° to 300° C.

The dry coal from the heating tower 15 is fed to a coating tower 17, cooled spontaniously to about 100° C. there, and coated with tar vapor transferred from the heater 23 together with a carrier gas of $N_2$ from a gas container 24. Gases in the coating tower 17 are discharged from an upper portion thereof, transferred to the gas burner 21, and burned together with gases from the separator 20. The combustion gas is used to dry the coal.

As a heat source for heating the heating pipes 14, 16, hot gas generated by combustion of coal heavy oil, etc. at a gas generator 18 is used.

In the above method, coal from mill 11 may be transferred directly to the heating tower 15 without drying at the drying tower and subjected both to moisture reduction and to tar production. In this case, although the drying tower is not required, operational cost may be higher than that required when the drying tower is used.

The present invention will now be further described by way of the embodiments thereof.

EXAMPLE 1

B coal from the U.S.A. having properties shown in Table 2 was heat-treated at 400° C. to distill off tar and then left in a saturated brine desiccator for 240 hours. The moisture content of the coal after this treatment was 6.2%. Then coating was conducted on this coal in the same way as in the experimental example described above at a tar feed rate of 5.2% by weight, a tar vapor temperature of 300° C. and a coal temperature of 50° C. As a result, the equilibrium moisture of the coal decreased to 2.1%, which is 4.1% less than the moisture content before the coating.

TABLE 2

| | | |
|---|---|---|
| Moisture content (wt %) | 28.8 | |
| Ash (wt %) | 8.8 | (dry weight basis) |
| Heating value (kcal/kg) | 5,800 | (dry weight basis) |
| C (wt %) | 59.2 | |
| H (wt %) | 5.4 | |
| N (wt %) | 0.9 | |

EXAMPLE 2

C coal from Australia having properties shown in Table 3 was subjected to a tar distilling heat-treatment at 400° C. and then left in a saturated brine desiccator for 240 hours, whereby the coal showed a moisture content of 6.4%. This coal was then coated in the same manner as in the experimental example described above at a tar feed rate of 3.2% by weight, a tar vapor temperature of 400° C. and a coal temperature of 100° C. The equilibrium moisture absorption of the coal was 3.6%, which is 2.8% less than the moisture content before the coating.

TABLE 3

| | | |
|---|---|---|
| Moisture content (wt %) | 10.6 | |
| Ash (wt %) | 17.1 | (dry weight basis) |
| Heating value (kcal/kg) | 6,540 | (dry weight basis) |
| C (wt %) | 71.4 | |
| H (wt %) | 4.9 | |
| N (wt %) | 1.4 | |

EXAMPLE 3

Australian D coal having properties shown in Table 4 was heat-treated at 300° C. for distilling off tar and then left in a saturated brine desiccator for 240 hours. The moisture content of the thus treated coal was 7.4%. This coal was further subjected to a coating treatment as in the experimental example described above at a tar feed rate of 4.6% by weight, a tar vapor temperature of 250° C. and a coal temperature of 20° C. As a result, the equilibrium moisture absorption of the coal decreased to 2.8%, or 4.6% less than the moisture content of the coal before the coating.

TABLE 4

| | |
|---|---|
| Moisture content (wt %) | 8.3 |
| Ash (wt %) | 8.2 (dry weight basis) |
| Heating value (kcal/kg) | 5,980 (dry weight basis) |
| C (wt %) | 57.2 |
| H (wt %) | 4.4 |
| N (wt %) | 1.8 |

EXAMPLE 4

E coal from Canada having properties shown in Table 5 was heated at 380° C. for distilling off tar and then left in a saturated brine desiccator for 240 hours, whereby the coal showed a moisture absorption of ·12%. Then this coal was coated in the same manner as in the experimental example described above at a tar feed rate of 6%, a tar vapor temperature of 280° C. and a coal temperature of 130° C. As a result, the equilibrium moisture absorption of the coal decreased to 6.2%, or 5.8% less than the moisture absorption before the coating.

TABLE 5

| | |
|---|---|
| Moisture content (wt %) | 22.4 |
| Ash (wt %) | 26.2 (dry weight basis) |
| Heating value (kcal/kg) | 3,340 (dry weight basis) |
| C (wt %) | 28.2 |
| H (wt %) | 4.2 |
| N (wt %) | 3.2 |

EXAMPLE 5

F coal from the U.S.A. having properties shown in Table 6 was heat-treated at 450° C. for distilling off tar and then left in a saturated brine desiccator for 240 hours. The resultant coal showed a moisture content of 14.2%. This coal was coated in the same manner as in the previously described experimental example at a tar feed rate of 3.8%, a tar vapor temperature of 360° C. and a coal temperature of 110° C. As a result, the equilibrium moisture absorption became 4.8%, which is 9.4% less than the moisture absorption of the coal before the coating.

TABLE 6

| | |
|---|---|
| Moisture content (wt %) | 29.2 |
| Ash (wt %) | 8.3 (dry weight basis) |
| Heating value (kcal/kg) | 4,420 (dry weight basis) |
| C (wt %) | 34.2 |
| H (wt %) | 4.9 |
| N (wt %) | 1.5 |

In each of the foregoing examples, the coal was coated with the tar distilled off from the same coal, but it is of course possible to use a tar distilled off from other coals.

Thus, it is possible according to this invention to coat a coal uniformly with tar, and the coal upgraded according to this invention has not only a reduced moisture during and after transport or storage but also an increased heating value per unit weight.

What is claimed is:

1. A method of coal upgrading comprising the steps of:

heat treating low-rank coal at a temperature not exceeding 600° C. to dehydrate the coal, to pyrolyze hydrophilic oxygen-containing groups of the coal and to distill off tar from the coal; and coating the surface of the coal subjected to said heat treating step with a portion of the tar by contacting tar vapor with the coal while keeping a temperature difference between the coal and the tar vapor in a range from 150° to 300° C.

2. A method of claim 1 further including the step of drying the low-rank coal at temperature lower than 200° C. prior to said heat treating step, and said heat treating step being conducted at a temperature from 200° to 600° C.

3. The method of claim 2, wherein said tar distilling off step includes the steps of:

collecting various gases including tar vapor; cooling the various gases to condensate the tar vapor; separating the condensated tar from the gases; and vaporizing the condensated tar to produce tar vapor.

4. The method of claim 3, wherein the tar vapor produced in said vaporizing step is fed onto the coal together with an inert carrier gas after performing said distilling off step.

5. The method of claim 2, wherein said drying step and said heat treating step are performed at temperatures of from 150° C. to 200° C. and at temperature from 350°–450° C., respectively.

6. A method of coal upgrading comprising the steps of:

heating low-rank coal at a temperature not exceeding 600° C. to reduce the moisture content of the coal and to obtain tar from the coal through destructive distillation;

cooling the coal reduced in its moisture content to a temperature lower than a heating temperature in said heating step; and coating the surface of the cooled coal with tar by contacting a portion of the distilled tar in the vapor state with the cooled coal; said coating being conducted with a temperature difference between the cooled coal and the tar vapor being in a range of from 150° to 300° C.

7. The method of claim 6, wherein said heating step comprising the steps of drying the coal at a lower temperature than 200° C. and of effecting destructive distillation of the dried coal at a temperature of 200° to 600° C. to obtain tar and to reduce the moisture content.

8. The method of claim 7, further including the step of pulverizing the coal prior to said drying step.

9. The method of claim 6, wherein the low-rank coal is heated initially to a temperature of 150° C. to dry the coal to a moisture content of 1 to 5% and, thereafter, the coal is heated to a temperature of from 350° to 450° C. to effect the destructive distillation.

10. The method of claim 9, wherein the heat-treated coal is cooled to a temperature of about 100° C. prior to the coating step.

* * * * *